United States Patent [19]

Burton et al.

[11] 4,326,568

[45] Apr. 27, 1982

[54] PACKAGING MACHINE WITH CONTINUOUS MOTION FILLER

[75] Inventors: Charles A. Burton; Robert C. Russell, both of Columbus, Ohio

[73] Assignee: Rexham Corporation, New York, N.Y.

[21] Appl. No.: 119,309

[22] Filed: Feb. 7, 1980

[51] Int. Cl.[3] ..... B65B 3/12

[52] U.S. Cl. ..... 141/114; 141/144; 141/146; 222/216

[58] Field of Search ..... 141/1-12, 141/37, 39-64, 67-70, 89-92, 129-195, 114, 313-317; 53/434, 469, 570, 381 R; 222/216

[56] References Cited

U.S. PATENT DOCUMENTS 3,230,687 1/1966 Nutting et al. ..... 53/562

3,371,689 3/1968 Carruthers ..... 141/146

3,552,454 1/1971 Deming ..... 141/146

*Primary Examiner*—Houston S. Bell, Jr.

*Attorney, Agent, or Firm*—Leydig, Voit, Osann, Mayer & Holt, Ltd.

[57] ABSTRACT

Flexible pouches are advanced continuously around an arcuate path and are filled with food chunks during the advance. A filling apparatus initially deposits the food chunks into metal containers which are circulated to a continuously rotating turret adapted to move the containers around the path in vertical registry with the pouches. As the containers are advanced by the turret, plungers force the food product out of the containers, through funnels and into the pouches. The empty containers then are removed from the turret and are returned to the filling apparatus.

12 Claims, 20 Drawing Figures

PACKAGING MACHINE WITH CONTINUOUS MOTION FILLER

BACKGROUND OF THE INVENTION

This invention relates to a machine for filling flexible pouches with product and particularly with a solid food product such as meat chunks or the like. The invention more specifically relates to a machine for filling the pouches while the pouches are advanced along a predetermined path with high speed continuous motion as opposed to slower intermittent motion. A machine with a continuous motion filling mechanism is disclosed in Nutting et al U.S. Pat. No. 3,230,687.

SUMMARY OF THE INVENTION

The general aim of the present invention is to provide a new and improved machine in which a relatively large quantity of product can be introduced into a relatively large number of pouches in a relatively short period of time.

A further object of the invention is to achieve the foregoing through the use of a unique system of free-floating containers adapted to circulate past filling apparatus which charges each container with product. The filled containers then are brought into registry with the continuously moving pouches, the product is forced out of the containers and into the pouches, and the empty containers are returned to the filling apparatus to receive additional product.

A more detailed object is to provide a relatively compact machine in which the containers are brought into registry with the pouches while the pouches are being advanced around an arcuate path and while the containers are held and advanced by a turret adapted to rotate about an axis which coincides with the center of the path.

A further object is to insure that all of the product in the containers is deposited into the pouches without contaminating the top seal areas of the pouches. This is achieved through the unique coaction of the containers with plungers, funnels and pouch openers which are carried on the turret. Specifically, each container is positioned between a plunger and a funnel when the container is delivered to the turret. The funnel then is moved downwardly and, as an incident thereto, causes novel pouch openers to duck into the pouch and spread the upper end of the pouch so that the funnel may enter the pouch below the top seal area thereof. The container then is moved downwardly into the funnel and is opened preparatory to the plunger moving downwardly through the container to force all of the product out of the container and into the pouch by way of the funnel.

The invention also resides in the unique construction of the containers and in the provision of a novel actuating mechanism which effects shifting of the funnels, the pouch openers, the containers and the plungers during the filling process.

These and other objects and advantages of the invention will become more apparent from the following detailed description when taken in conjunction with the accompanying drawings.

DETAILED DESCRIPTION OF THE PREFERRED EMBODIMENT

Figure 1:
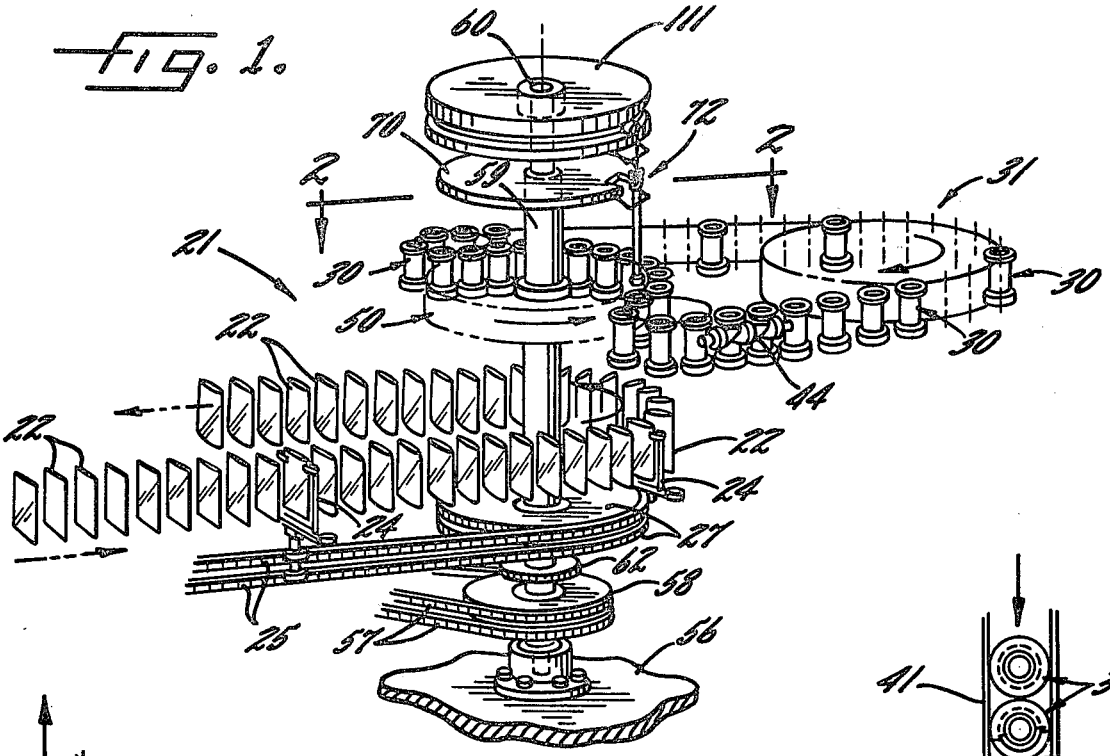
FIG. 1 is a fragmentary perspective view which shows, in somewhat schematic form, a new and improved machine incorporating the unique features of the present invention.

As shown in the drawings for purposes of illustration, the invention is embodied in a packaging machine 21 in which upright pouches 22 made of flexible, heat-sealable material are advanced in spaced relation along a predetermined path and are filled with product during the advance. In the present instance, each pouch is held by a carrier 24 which is attached to a pair of upper and lower continuously movable chains 25. Each carrier includes a pair of clamps 26 which grip the side margins of the pouch. For a detailed disclosure of the carriers reference may be made to Russell et al U.S. Pat. No. 4,263,768.

The chains 25 are trained around and are driven by a pair of vertically spaced sprockets 27 and are advanced with high speed continuous motion rather than with intermittent or start:stop motion. As shown in FIG. 1, the chains cause the pouches 22 to advance along a straight path at the forward side of the machine 21, to curve around an arcuate path at the downstream end of the machine and to recede along a second straight path at the rear side of the machine. While the pouches are being advanced along the straight path at the front side of the machine, a liquid product such as meat sauce or gravy is introduced into the pouches. The tops of the pouches are sealed as the pouches advance along the rear side of the machine.

In accordance with the present invention, a second product, preferably a solid food product such as meat chunks 28 (FIGS. 4 and 19) or the like, is introduced into the pouches 22 as the pouches curve around the arcuate path at the downstream end of the machine. The product is introduced into the pouches in a unique manner which enables a relatively large quantity of solid product to be deposited into the pouches as the latter move at high speeds, which insures that a precisely predetermined quantity of product will be introduced into each pouch and which prevents the top heat seal areas of the pouches from becoming contaminated with the product.

In general, filling of the pouches 22 with meat chunks 28 is carried out through the use of a system of metal containers 30 (FIGS. 1, 2 and 4) associated with a filling apparatus 31 (FIG. 1) and adapted to circulate from the filling apparatus, to the pouches curving around the downstream end of the machine 21, and then back to the filling apparatus. The filling apparatus per se does not form part of the present invention and thus the filling apparatus has only been shown schematically in FIG. 1. It will suffice to say that the filling apparatus includes mechanism for charging each container 30 with a precisely predetermined quantity of meat chunks 28 as the containers move around a curved path through the filling apparatus.

Figure 5:
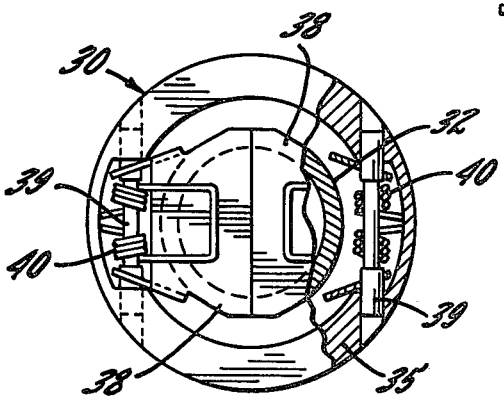
FIG. 5 is a fragmentary cross-section taken substantially along the line 5—5 of FIG. 4.
Figure 4:
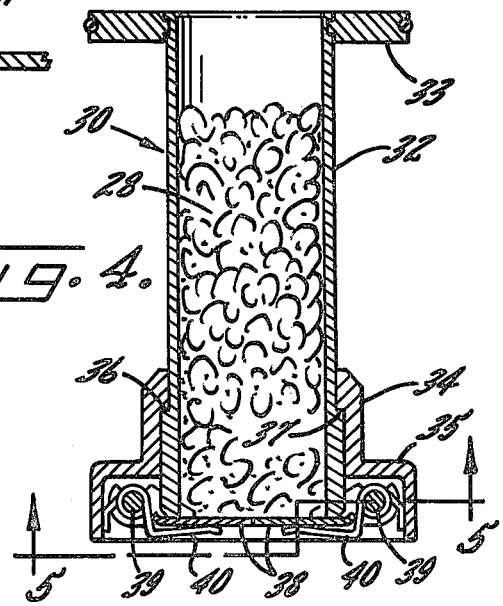
FIG. 4 is a cross-sectional view taken axially through one of the containers.

One of the containers 30 is shown in FIGS. 4 and 5 and comprises an upper sleeve 32 having a radially extending flange 33 fixed to its upper end. The lower end portion of the upper sleeve is telescoped into a lower sleeve 34 whose lower end portion is formed with a downwardly opening and radially extending collar 35. Mating shoulders 36 and 37 (FIGS. 4, 19 and 20) on the outside of the upper sleeve 32 and on the inside of the lower sleeve 34 engage one another to limit upward movement of the upper sleeve relative to the lower sleeve.

The lower end of the upper sleeve 32 of each container 30 normally engages and is closed by a gate which is carried by the lower sleeve 34. Herein, the gate is formed by a pair of doors 38 (FIGS. 4, 5, 19 and 20) which are pivotally mounted on a pair of horizontally extending and parallel pins 39 supported on the inside of the collar 35 of the lower sleeve 34. Torsion springs 40 are telescoped over the pins and engage the lower sides of the doors 38 to urge the doors upwardly to closed positions in which the doors retain the meat chunks 28 in the upper sleeve 32. When the upper sleeve 32 is slid downwardly within the lower sleeve 34, the lower end of the upper sleeve engages the upper sides of the doors 38 and swings the doors downwardly to open positions (see FIG. 20) and thereby permit the chunks to fall out of the upper sleeve.

The filled containers 30 which are delivered from the filling apparatus 31 move in a free-floating manner along a chute 41 (FIG. 2) to a supply station 42. At the supply station, a power-rotated auger 44 engages the containers and establishes a predetermined spacing between the containers. The spaced containers then are picked up and advanced by a pair of vertically spaced wheels 45 adapted to be rotated continuously in a clockwise direction about an upright axis and each having twelve angularly spaced pockets 46 which successively receive the containers.

As the wheels 45 rotate, the containers 30 are advanced around a curved portion 47 (FIG. 2) of the chute and are successively delivered to a turret 50 which is adapted to be rotated continuously in a counterclockwise direction about an upright axis. As the turrent 50 rotates, the containers 30 overlie and register vertically with the pouches 22 being advanced by the chains 25 along the arcuate path extending around the sprockets 27 at the downstream end of the machine 21. The turret moves the containers 30 around the arcuate path at the same speed as the pouches 22 and, during such movement, the meat chunks 28 in the containers are delivered downwardly into the pouches.

When each empty container 30 reaches approximately a nine o'clock position around the turret 50, the container moves into a curved portion 51 (FIG. 2) of a chute 52. The containers are delivered into the chute and are picked off from the turret by a pair of vertically spaced wheels 53 adapted to be rotated in a clockwise direction about an upright axis and each having twelve angularly spaced pockets 54 for receiving the containers and for advancing the containers around the curved portion 51 of the chute 52. After the containers leave the wheels 53, the containers push one another along the chute 52 and return to the filling apparatus 31 to be re-filled with meat chunks 28.

To rotate the sprockets 27, the wheels 45 and 53 and the turret 50, the machine 21 includes a continuously rotating cycle shaft 54 (FIGS. 2 and 3) which acts through a right angle gear box 55 mounted on the main frame 56 of the machine. A pair of vertically spaced chains 57 lead from the output of the gear box and are trained around a pair of vertically spaced sprockets 58. The sprockets 58 are keyed to a vertical sleeve 59 which defines the center or axis of the turret 50 and which rotates on a rod 60 extending through the sleeve. The rod is stationary and its lower end is secured rigidly to the frame 56 as indicated at 61 in FIG. 3. Thus, the chains 57 rotate the sprockets 58 and cause the sleeve 59 of the turret 50 to rotate on the stationary rod 60.

Figure 2:
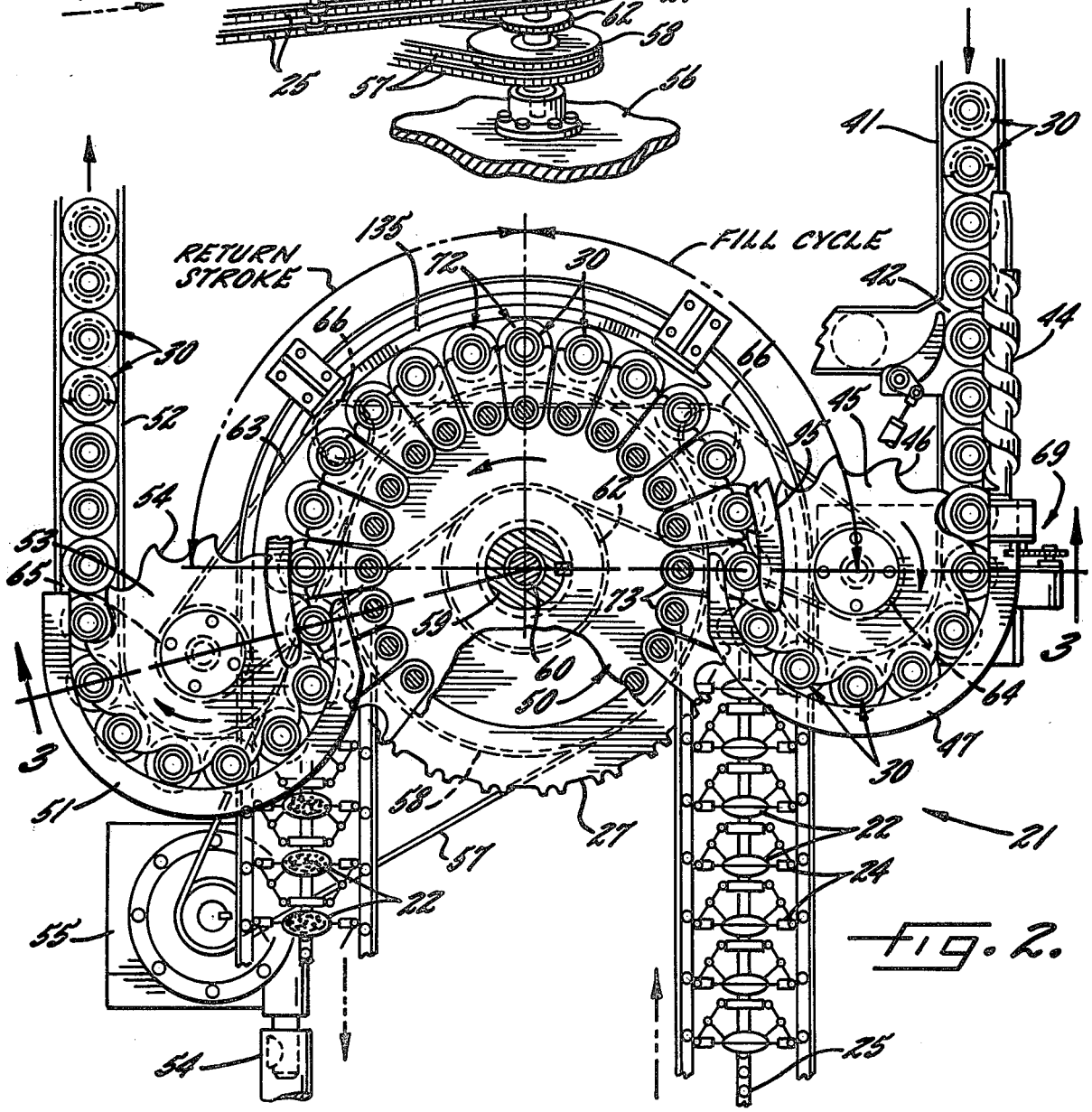
FIG. 2 is an enlarged cross-section of part of the machine shown in FIG. 1 and is taken along the line 2—2 of FIG. 1.

Located above the sprockets 58 is yet another sprocket 62 (FIG. 3) which also is keyed to the sleeve 59 so as to rotate with the sleeve. A chain 63 engages the sprocket 62 and loops around a pair of sprockets 64 and 65 (FIG. 3) and a pair of idler sprockets 66 (FIG. 2). The sprocket 64 is fixed to the lower end of a rotatable shaft 67 (FIG. 3) which supports the wheels 45 while the sprocket 65 is similarly fixed to the lower end of a rotatable shaft 68 which supports the wheels 53. Accordingly, the wheels 45 and 53 are rotated in timed relation with the turret 50. A drive mechanism indicated generally at 69 in FIG. 3 receives its input from the shaft 67 and serves to rotate the auger 44.

The sprockets 27 (FIG. 3) for the chains 25 are located above the sprocket 62 and are also keyed to the sleeve 59. Thus, the sprockets 27 are rotated by the sleeve 59 and cause the chains 25 and the pouches 22 to advance in timed relation with rotation of the turret 50.

Figure 3:
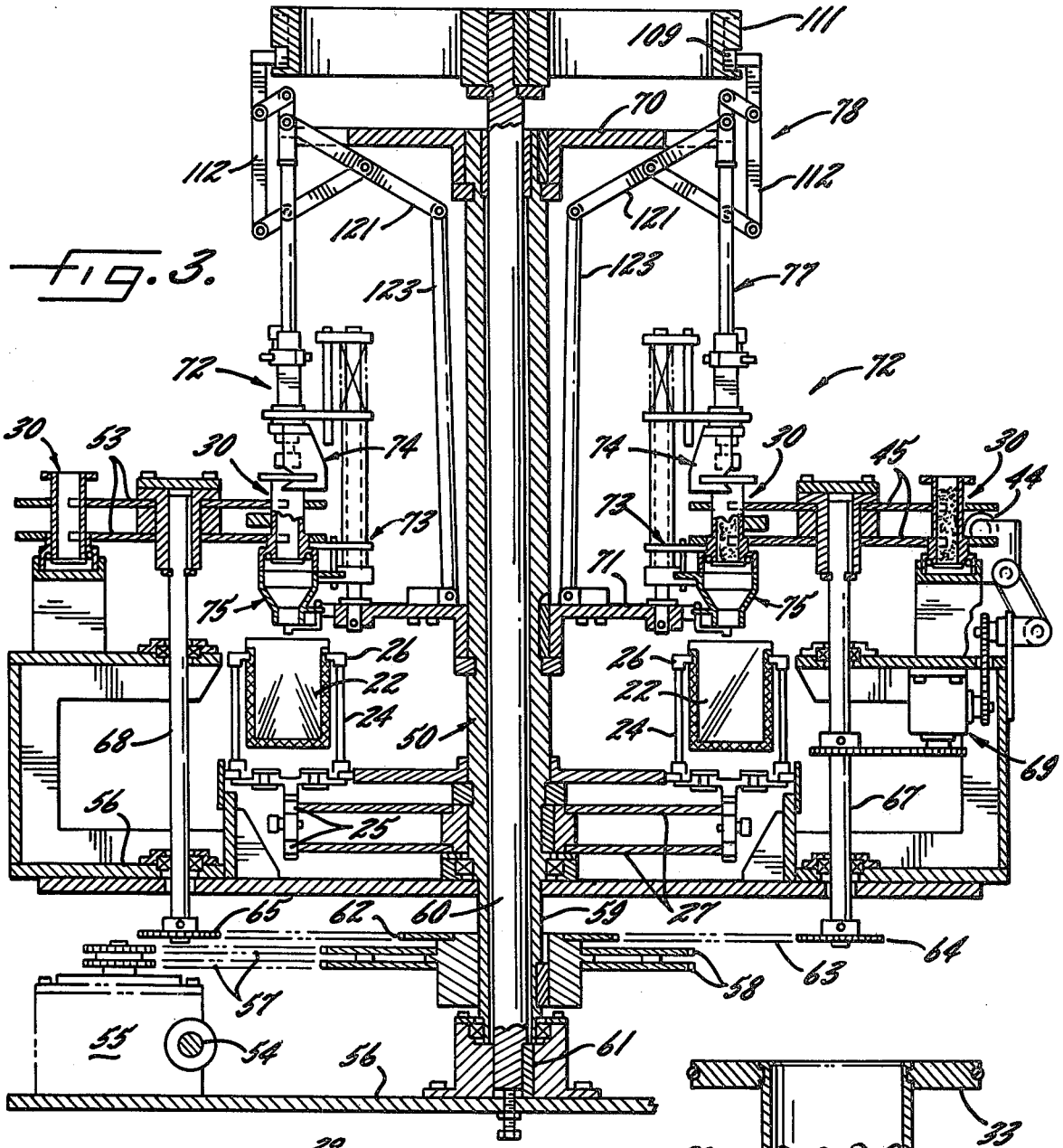
FIG. 3 is a fragmentary cross-section taken substantially along the line 3—3 of FIG. 2.

As shown in FIG. 3, the turret 50 includes upper and lower plates 70 and 71 which are keyed to and rotate with the sleeve 59. Spaced angularly around and rotatable with the plates are several identical units 72 which effect dispensing of the meat chunks 28 from the containers 30 and into the pouches 22 as the containers move counterclockwise around the turret 50 from approximately a three o'clock position to approximately a twelve o'clock position. In the present instance, there are twenty-four dispensing units 72 on the turret.

In general, each dispensing unit 72 comprises a pair of lower and upper holders 73 and 74 (FIG. 10) for captivating the container 30 on the turret 50, a funnel 75 (FIGS. 10, 19 and 20) which underlies the container and which is adapted to duck downwardly into the underlying pouch 22, a pair of pouch openers 76 which spread the upper end portion of the pouch to allow the funnel to enter the pouch, and a plunger 77 which initially is located above the container and which forces the meat chunks 28 downwardly out of the container, through the funnel and into the pouch. In addition, each dispensing unit 72 includes a unique actuating mechanism 78 (FIG. 6) which effects shifting of the container, the funnel, the pouch openers and the plunger when the meat chunks 28 are delivered from the container to the pouch.

More specifically, the lower holder 73 (FIG. 10) of each dispensing unit 72 is in the form of a fork having a substantially U-shaped notch 79 for receiving the container 30. When the container is delivered to the turret 50 by the wheels 45, the lower sleeve 34 of the container is moved into the notch 79 and is embraced by the fork 73. At the time of delivery of the container, the funnel 75 is in a raised position and, as the container moves into the fork 73, the lower end of the collar 35 of the container moves across and rests on the upper side of the funnel (see FIG. 10). The lower side of the fork 73 engages the upper side of the collar 35.

Figure 6:
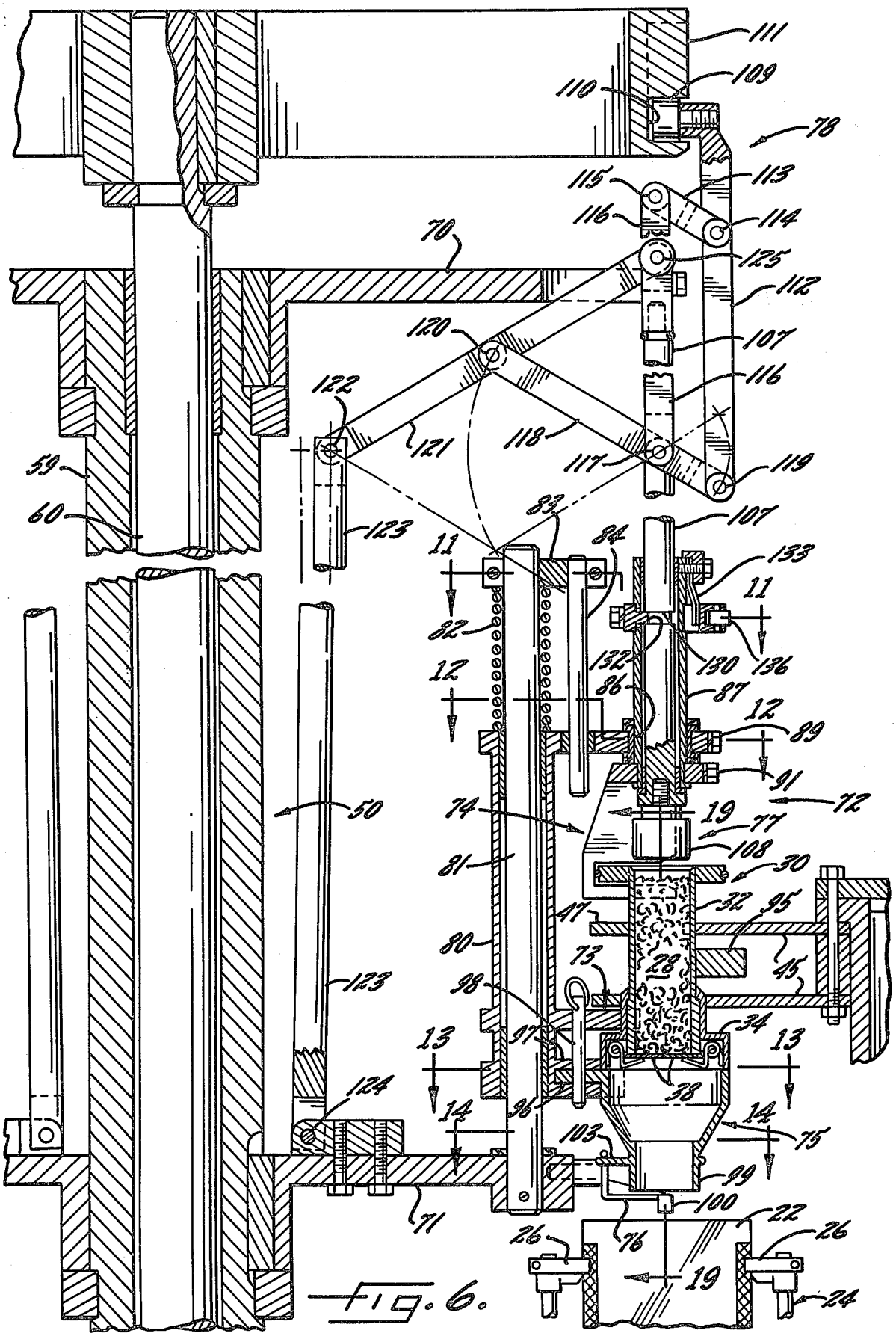
FIG. 6 is an enlarged view of certain parts shown in FIG. 3.
Figure 11:
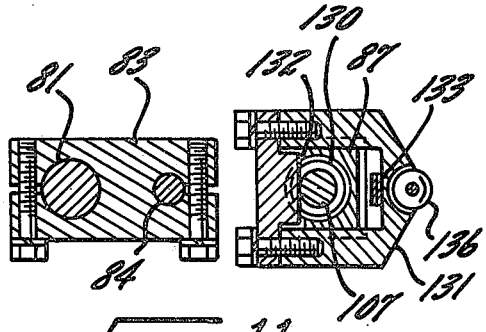
FIGS. 11, 12, 13 and 14 are fragmentary cross-sections taken substantially along the lines 11—11, 12—12, 13—13 and 14—14, respectively, of FIG. 6.
Figure 12:
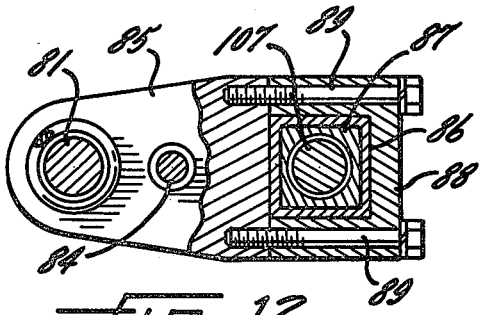
Figure 13:
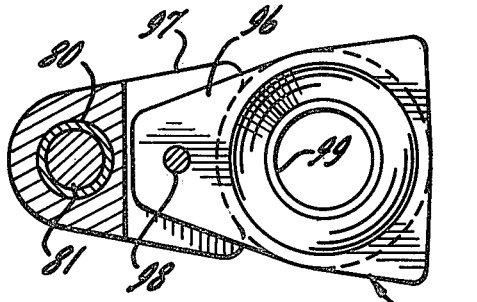
Figure 14:
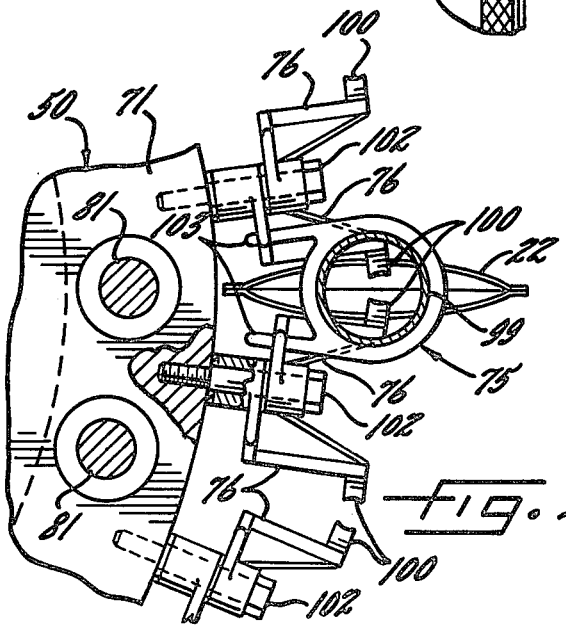

The holding fork 74 is attached to the lower end portion of a vertical sleeve 80 (FIGS. 6 and 10) which, in turn, is telescoped slidably onto a vertical rod 81 whose lower end is fixed to the lower plate 71 of the turret 50. A coil spring 82 is telescoped over the upper end portion of the rod 81 and is compressed between the upper end of the sleeve 80 and a fixed bracket 83 (FIGS. 6 and 11) on the upper end of the rod. Thus, the spring 82 urges the sleeve 80 to slide downwardly on the rod 81. The sleeve 80 is prevented from turning on the rod 81 by pin 84 whose upper end is fixed to the bracket 83 and whose lower end extends slidably through a hole in a second bracket 85 (FIGS. 6 and 12). The bracket 85 is rigid with and projects radially from the upper end of the sleeve 80. As shown in FIGS. 6 and 12, the bracket 85 rigidly supports a square bushing 86 which, in turn, slidably receives a square sleeve 87. The bushing is clamped to the bracket 85 by a block 88 and by screws 89.

The upper holder 74 is clamped rigidly to the lower end of the square sleeve 87 by a block 90 (FIG. 10) and by screws 91. Herein, the upper holder is a substantially U-shaped member whose lower end is formed with a slot 92 and with a pair of spaced fingers 93. When the container 30 is delivered to the turret 50, the flange 33 on the upper sleeve 32 of the container moves into the slot 92 and overlies the fingers 93 while surfaces 94 (FIG. 19) of the upper holder are disposed above the flange. The upper sleeve is received between and is embraced by the fingers.

With the foregoing arrangement, the container 30 may be moved into the holders 73 and 74 by the wheels 45. The holders coact with the funnel 75 to support the container vertically and, in addition, the circumferential embracement of the container by the holders captivates the container for rotary movement with the turret 50. A fixed rail 95 (FIGS. 2 and 6) extends around the outer side of the turret and slidably engages the outer sides of the containers to prevent the containers from falling radially out of the holders.

Figure 10:
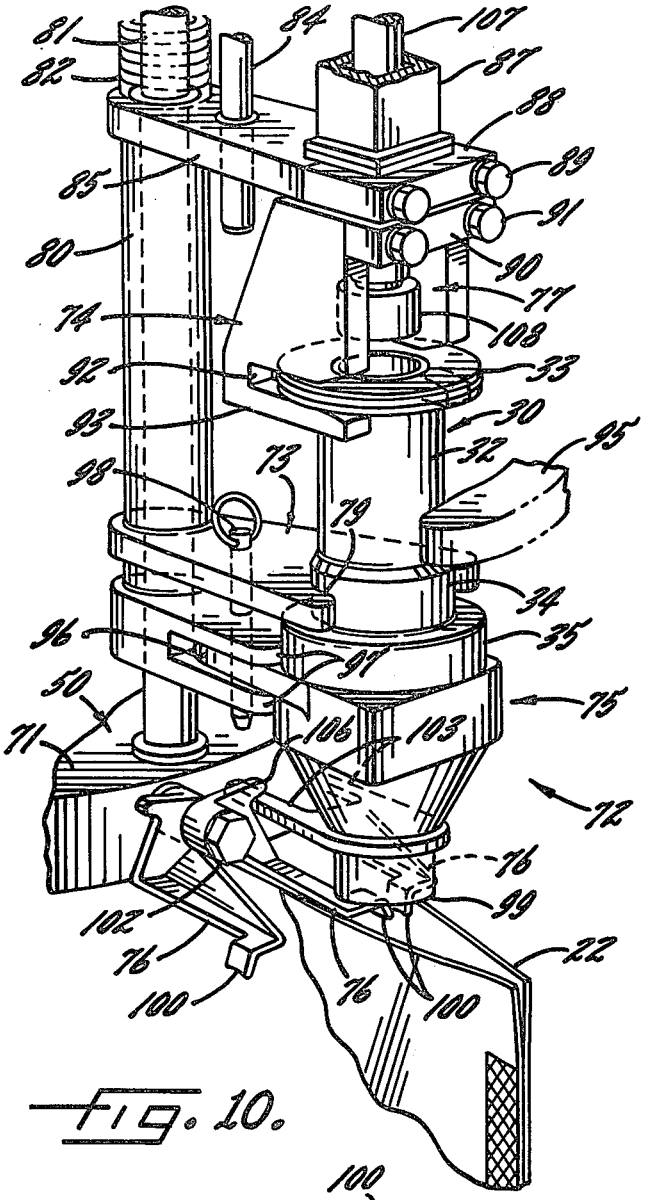
FIG. 10 is a fragmentary perspective view showing part of the turret and showing a plunger, a container, a funnel and the pouch openers.

The funnel 75 of each dispensing unit 72 is located immediately below the container 30 and is formed with a radially extending tongue 96 (FIG. 10). The latter fits into a clevis 97 which projects radially from the sleeve 80. A vertical pin 98 extends releasably through the lower holding fork 73, the clevis 97 and the tongue 96 to hold the tongue in the clevis while permitting the funnel 75 to be removed from the clevis for purposes of cleaning the funnel. The upper end portion of the funnel is circular in cross-section and engages an arcuate surface on the clevis to prevent the funnel from turning relative to the clevis. The lower end portion of the funnel is defined by a reduced diameter spout 99.

Figure 19:
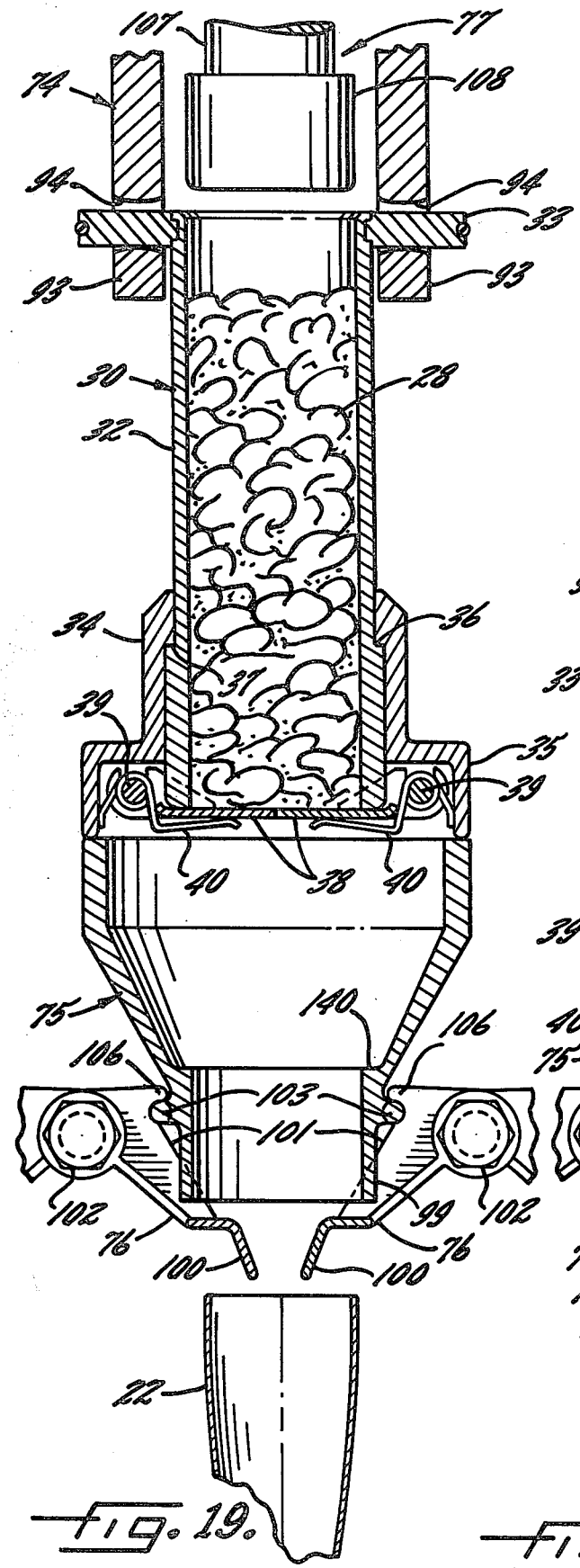
FIG. 19 is an enlarged fragmentary cross-section taken substantially along the line 19—19 of FIG. 6.

Located beneath the spout 99 of the funnel 75 are the pouch openers 76 (FIGS. 14, 15, 19 and 20). The two pouch openers of each dispensing unit 72 are positioned generally on opposite sides of the spout and each is formed with an outer downturned finger 100 which is adapted to enter the pouch. One side edge of each pouch opener defines an inclined cam surface 101 (FIG. 19). The inner end portion of each pouch opener is pivotally mounted on a horizontally extending pin 102 which is secured to the lower plate 71 of the turret 50. Each pin serves as a mounting for the trailing pouch opener 76 of a leading dispensing unit 72 and as a mounting for the leading pouch opener of the adjacent trailing dispensing unit.

Figure 15:
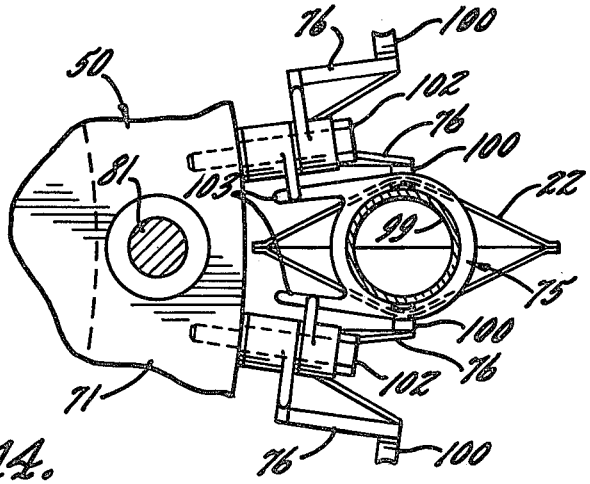
FIG. 15 is a view similar to FIG. 14 but shows certain parts in moved positions.
Figure 20:
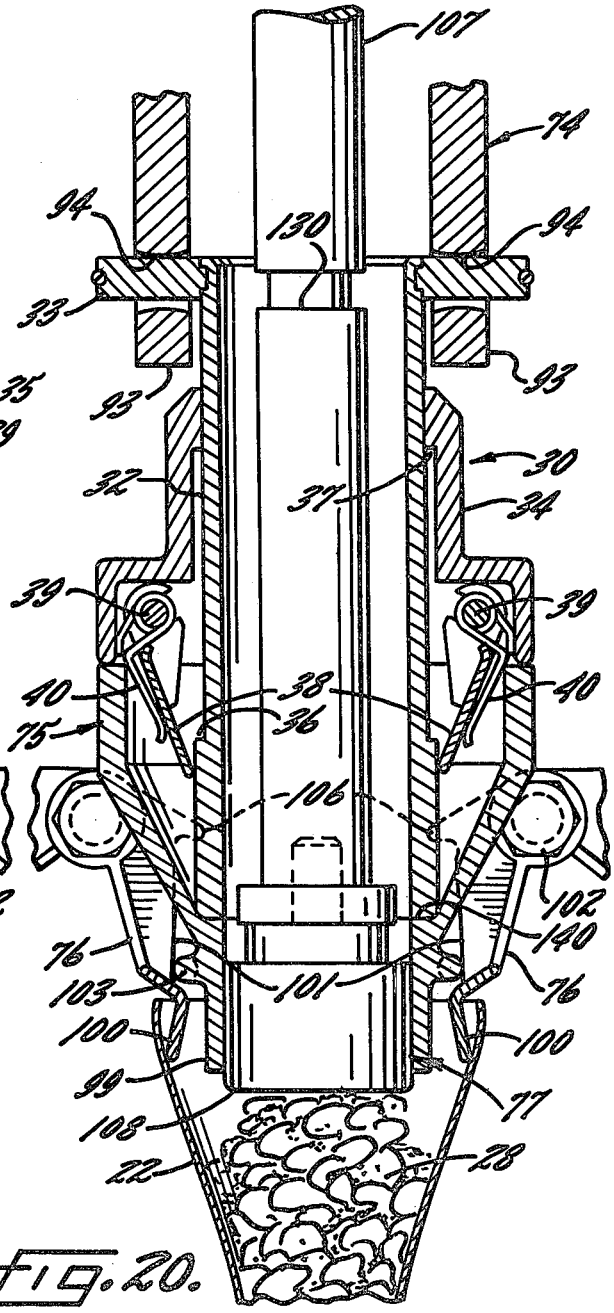
FIG. 20 is an enlarged fragmentary cross-section taken substantially along the line 20—20 of FIG. 18.

When a funnel 75 first moves into vertical registry with a pouch 22, the two pouch openers 76 are located above the pouch with their fingers 100 positioned just above the upper end of the pouch and with their cam surfaces 101 positioned in engagement with a fork 103 which projects rearwardly from the spout (see FIGS. 10 and 19). As the funnel initially moves downwardly, the fork 103 cams against the openers. This causes the openers to pivot in opposite directions about their mounting pins 102 and causes the fingers 100 to duck into the pouch and engage the side walls thereof. With continued downward movement of the funnel, the openers are pivoted further about the pins so that the fingers spread the side panels of the pouch as shown in FIGS. 15 and 20. Such spreading opens the mouth of the pouch to enable the spout 99 to move downwardly into the pouch to a level below the top seal area of the pouch. Accordingly, the top seal area of the pouch will not become contaminated by the meat chunks 28 when the latter are dispensed through the funnel.

When the funnel 75 is shifted upwardly, the fork 103 (FIG. 10) engages ears 106 (FIG. 19) on the pouch openers. Such engagement pivots the pouch openers reversely to first move the fingers 100 toward each other and to then lift the fingers out of the pouch.

The plunger 77 for forcing the meat chunks 28 out of the container 30 includes a vertical rod 107 (FIG. 6) which is telescoped slidably into the sleeve 87. A cylindrical head 108 is attached to the lower end of the rod and has an outside diameter which very closely approximates the inside diameter of the upper sleeve 32 of the container 30 so that the head will force all of the meat chunks out of the container.

When each container 30 is first delivered to the turret 50, the plunger 77 is located in a raised inactive position with its head 108 disposed above the upper end of the container (see FIG. 19). During subsequent rotation of the turret 50, the plunger is shifted downwardly to a lowered active position to cause the head 78 to move through the container and force the meat chunks 28 therefrom (see FIG. 20). The plunger then is retracted back upwardly to its raised position.

Vertical reciprocation of the plunger 77 is effected by the actuating mechanism 78. As shown in FIG. 6, the actuating mechanism 78 for each dispensing unit 72 includes a cam follower 109. Each cam follower is adapted to travel in an annular groove or cam track 110 which is formed around the periphery of a cylindrical drum 111. The drum is located in a stationary position above the upper plate 70 of the turret 50 and is fixed rigidly to the stationary shaft 60. The cam track 110 falls and rises as it progresses around the drum and thus causes the follower 109 of each dispensing unit 72 to move downwardly and upwardly to effect vertical shifting of the plunger 77 of the unit.

Figure 7:
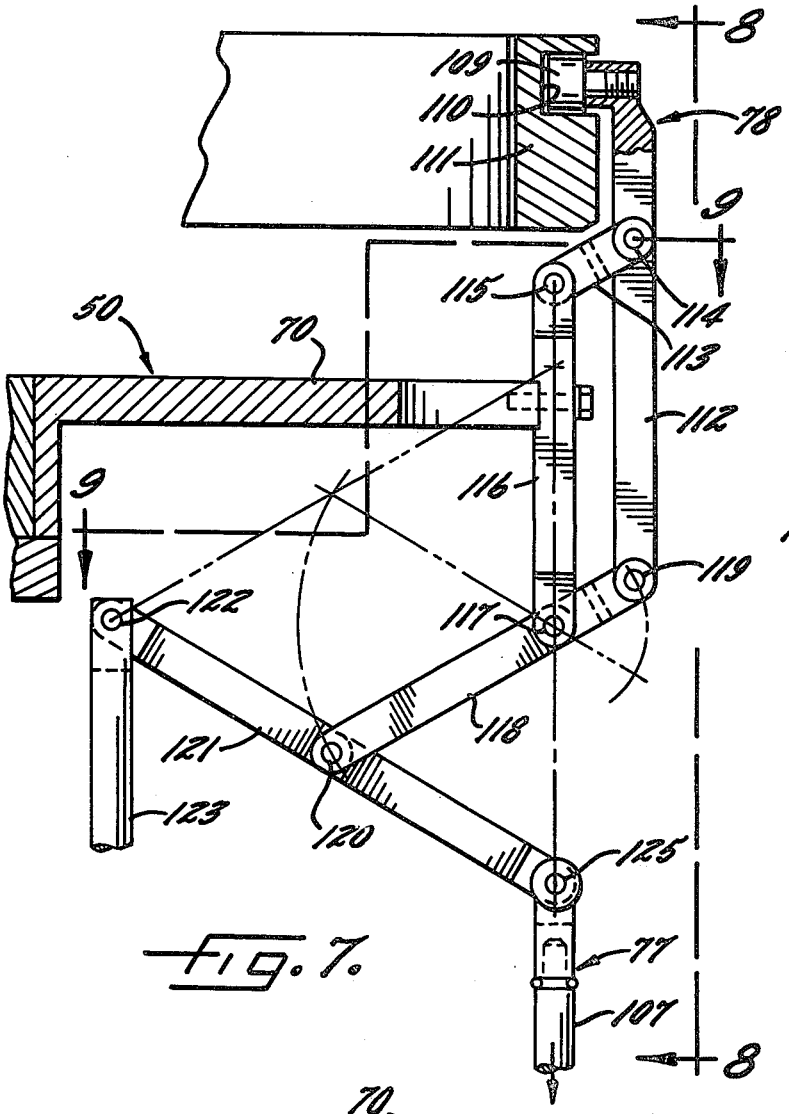
FIG. 7 is a view of certain parts illustrated in FIG. 6 but shows those parts in moved positions.
Figure 8:
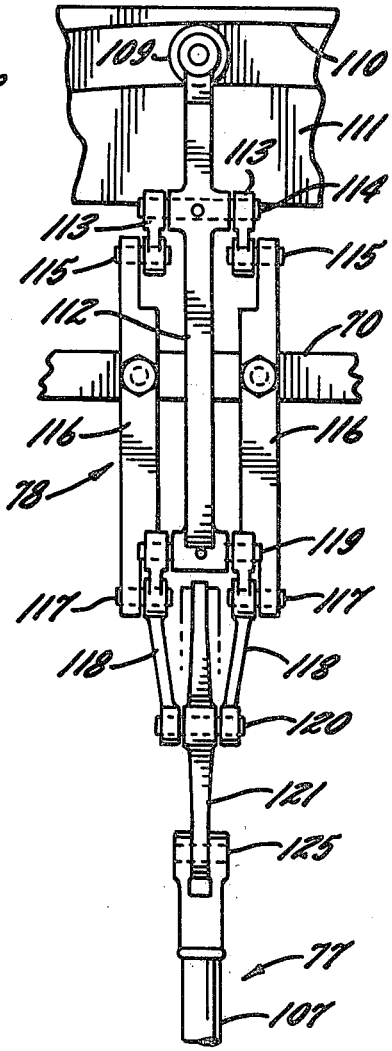
FIGS. 8 and 9 are views taken substantially along the lines 8—8 and 9—9 respectively, of FIG. 7.
Figure 9:
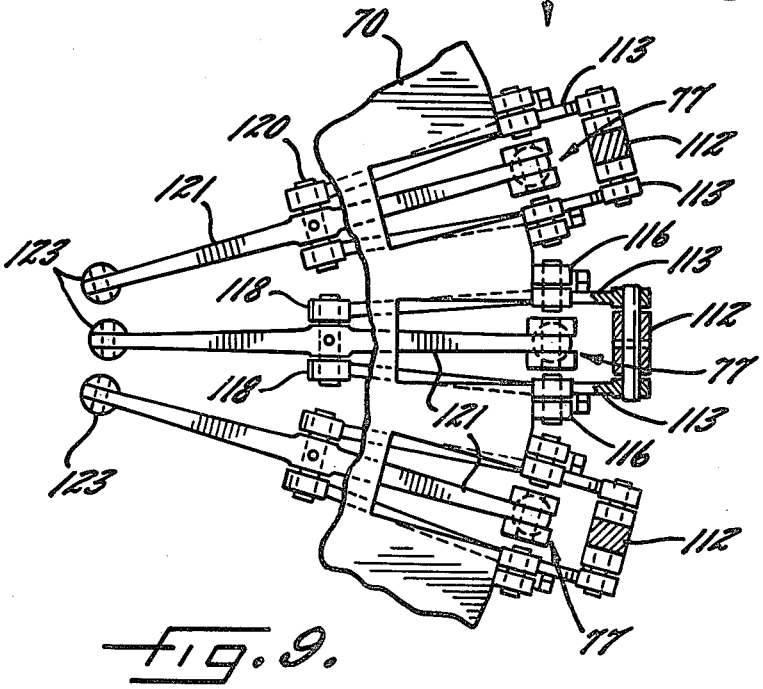

Means are provided for amplifying the vertical movements of each cam follower 109 so as to enable a cam track 110 with relatively short vertical rises and falls to produce substantially greater vertical displacement of the plunger 77. Herein, the motion amplifying means comprise a link 112 (FIGS. 6 to 9) whose upper end is connected to the follower 109. Two links 113 are pivotally connected at their ends at 114 to the link 112 between the ends of the link 112. The other ends of the links 113 are pivotally connected at 115 to the upper ends of a pair of stationary straps 116 which are rigidly secured to the upper plate 70 of the turret 50. At their lower ends, the straps 116 are pivotally connected at 117 between the ends of yet another pair of links 118. One end of each of the links 118 is pivotally connected at 119 to the lower end of the link 112 while the other end of each link 118 is pivotally connected at 120 to the midpoint of a lever 121. One end of the lever 121 is pivotally connected at 122 to the upper end of an upright rod 123 whose lower end is pivotally connected at 124 to the lower plate 71 of the turret 50. The opposite end of the lever 121 is pivotally connected at 125 to the upper end of the rod 107 of the plunger 77. p With the foregoing arrangement, the cam follower 109 and the links 118 are pulled upwardly as the follower moves from a fall (FIG. 6) in the cam track 110 to a rise (FIG. 7) in the track. The links 118 are swung counterclockwise about the pivot 117 and this, in turn, causes the lever 121 to turn clockwise about the pivot 122 and shift the plunger 77 downwardly. Reverse motion occurs and the plunger 77 is retracted upwardly when the follower 109 moves from a rise to a fall in the track 110. Because of the motion amplification effected by the links 118 and the lever 121, every inch of displacement of the cam follower 109 produces about $5\frac{1}{4}$ inches displacement of the plunger 77.

In carrying out the invention, downward movement of the plunger 77 is uniquely used to first lower the funnel 75 into the pouch 22 and then to slide the upper sleeve 32 of the container 30 downwardly into the funnel and relative to the lower sleeve 34 of the container in order to open the doors 38 and permit dispensing of the meat chunks 28. This is achieved in part by selectively latching the plunger 77 and the sleeve 87 together for vertical movement in unison and then by releasing the plunger from the sleeve 87 to allow the plunger to move while the sleeve remains stationary.

More particularly, the rod 107 of the plunger 77 is formed with an annular groove 130 (FIGS. 6 and 20) which serves as a latching groove. Located above the bracket 85 and telescoped nonrotatably over the square sleeve 87 is a box-like latching device 131 (FIGS. 6 and 11) formed with a radially extending detent 132 which projects through a slot in the sleeve 87. The latching device 131 is capable of sliding radially on the sleeve 87 between latched and unlatched positions. When the latching device is in its latched position, the detent 132 projects into the groove 130 to couple the sleeve 87 and the plunger 77 for vertical movement in unison. The latching device 131 is urged to its latched position by a leaf spring 133 (FIGS. 6 and 11) which is cantilevered on the sleeve 87 and which biases the latching device to the right to hold the detent 132 in the groove 130.

Figure 17:
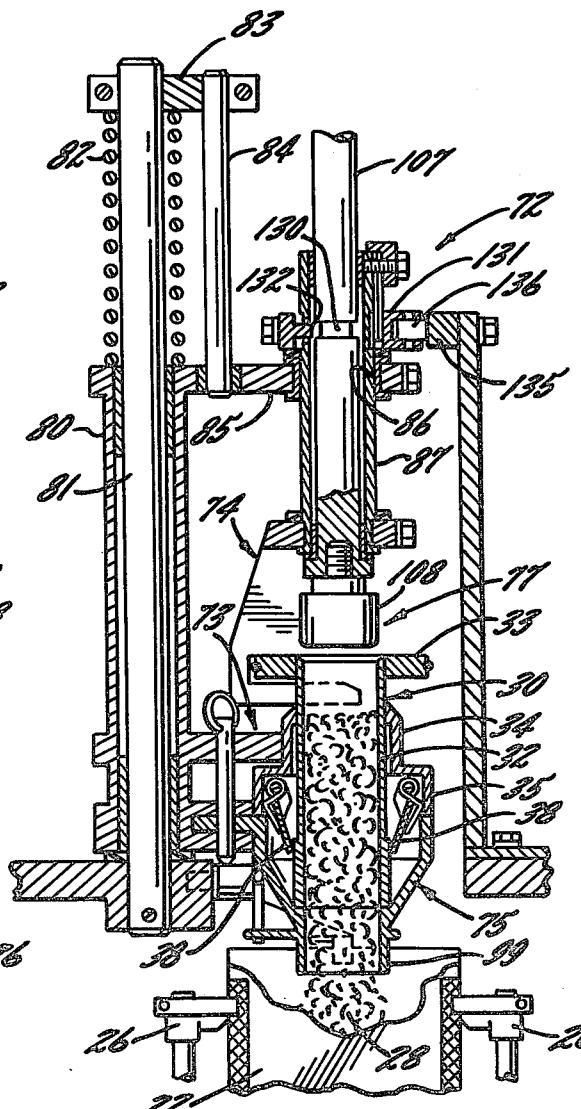

When the latching device 131 is shifted to the left to its unlatched position, the detent 132 is pushed out of the groove 130 and frees the plunger 77 to move vertically relative to the sleeve 87. Leftward shifting of the latching device is effected by a stationary cam track 135 (FIG. 17) extending partially around the turret 50 and fixed to the main frame 56 of the machine 21. The cam track 135 acts against a roller follower 136 which is carried by the outer side of the latching device 131.

SUMMARY OF OPERATION

Let it be assumed that one of the filled containers 30 has been delivered past the auger 44 and has been picked up by the wheels 45. At this time, the upper sleeve 32 of the container 30 is held upwardly in the lower sleeve 34 by virtue of the spring-urged doors 38 pressing against the lower end of the upper sleeve 32 and pushing the upper sleeve upwardly within the lower sleeve 34 until the shoulder 36 abuts the shoulder 37 (see FIG. 4). The closed doors 38 retain the meat chunks 28 in the upper sleeve 32.

As the container 30 approaches a nine o'clock position on the wheels 45, the holders 73 and 74 of a dispensing unit 72 approach a three o'clock position on the turret 50 to enable control of the container to be transferred from the wheels to the turret. At this time, the funnel 75 of the dispensing unit is in a raised position and is starting to move into registry with a pouch 22 which is beginning to curve around the sprockets 27. The pouch openers 76 are positioned above the upper end of the pouch (see FIGS. 6 and 20). Also, the plunger 77 is in a fully retracted inactive position as shown in FIGS. 6 and 20 and is located above the level of the container 30. The latching device 131 is in its latched position and thus the detent 132 holds the plunger 77 and the sleeve 87 for vertical movement in unison.

When control of the container 30 is transferred from the wheels 45 to the turret 50, the flange 33 of the container moves into the slot 92 of the upper holder 74 and into overlying relation with the fingers 93. The lower sleeve 34 of the container moves into the notch 79 of the lower holding fork 73 and, at the same time, the lower end of the container moves into registry with and rests on the upper side of the funnel 75 (see FIG. 10). Thus, the container is carried around by the turret and is alined vertically with the pouch 22, the funnel 75 and the plunger 77.

Just shortly after control of the container 30 has been taken over by the turret 50, the cam follower 109 (FIG. 6) encounters a rise in the cam track 110 and begins shifting the plunger 77 downwardly from the position shown in FIG. 6. Because the plunger and the sleeve 87 are latched together by the detent 132, the sleeve moves downwardly in unison with the plunger. The sleeve 87 forces downwardly against the upper holder 74 so as to move the upper holder downwardly and to permit the bushing 86, the bracket 85 and the sleeve 80 to move downwardly. The surfaces 94 (FIG. 19) of the holder 74 press against the flange 33 of the container 30 and move the container downwardly. At the same time, the spring 82 forces the sleeve 80 downwardly and, by way of the clevis 97, the sleeve 80 shifts the funnel 75 downwardly in unison with the container.

As the funnel 75 initially moves downwardly, the fork 103 on the funnel engages the pouch openers 76 and causes the openers to pivot downwardly about their mounting pins 102. The fingers 100 of the openers thus duck into the upper end of the pouch 22 and then spread the mouth of the pouch widely to permit the spout 99 of the funnel to enter the pouch (see FIGS. 15 and 20).

Figure 16:
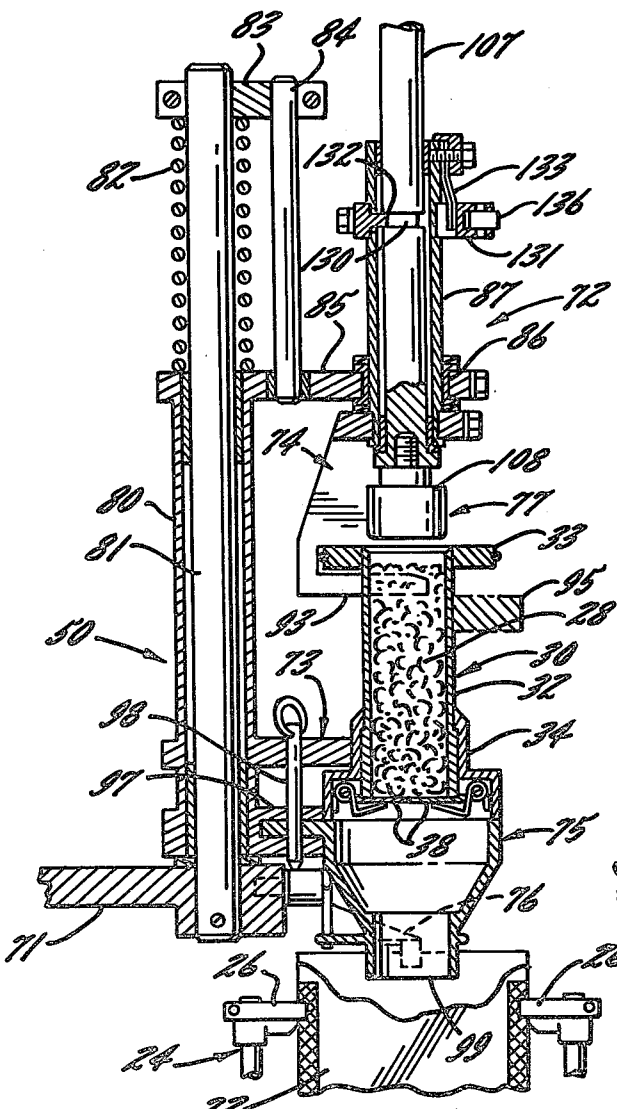

With continued downward movement of the plunger 77 and the funnel 75, the spout 99 moves into the pouch 22 to a level below the top seal area thereof (see FIG. 16) so that the meat chunks 28 will not contact and contaminate the top seal area when the chunks are subsequently dispensed through the spout. The lower end of the sleeve 80 then engages the lower plate 71 of the turret 50 so as to stop further downward movement of the sleeve 80, the funnel 75, the lower sleeve 34 of the container 30, and the bracket 85.

The plunger 77, however, continues its downward movement and, since the bracket 85 is stopped and the plunger is latched to the sleeve 87, the plunger causes the sleeve 87 to move downwardly within the bushing 86. The sleeve 87 pushes downwardly on the upper holder 74 whose surfaces 94, in turn, push downwardly on the flange 33 of the upper sleeve 32 of the container 30 to cause the upper sleeve to slide downwardly within the lower sleeve 34 of the container. As a result, the lower end of the upper sleeve 32 engages and opens the doors 38 (see FIG. 17) to permit the meat chunks 28 to begin falling from the upper sleeve 32, through the spout 99, and into the pouch 22. The upper sleeve 32 stops its downward movement when its lower end approaches an internal shoulder 140 (FIGS. 19 and 20) in the funnel 75.

Figure 18:
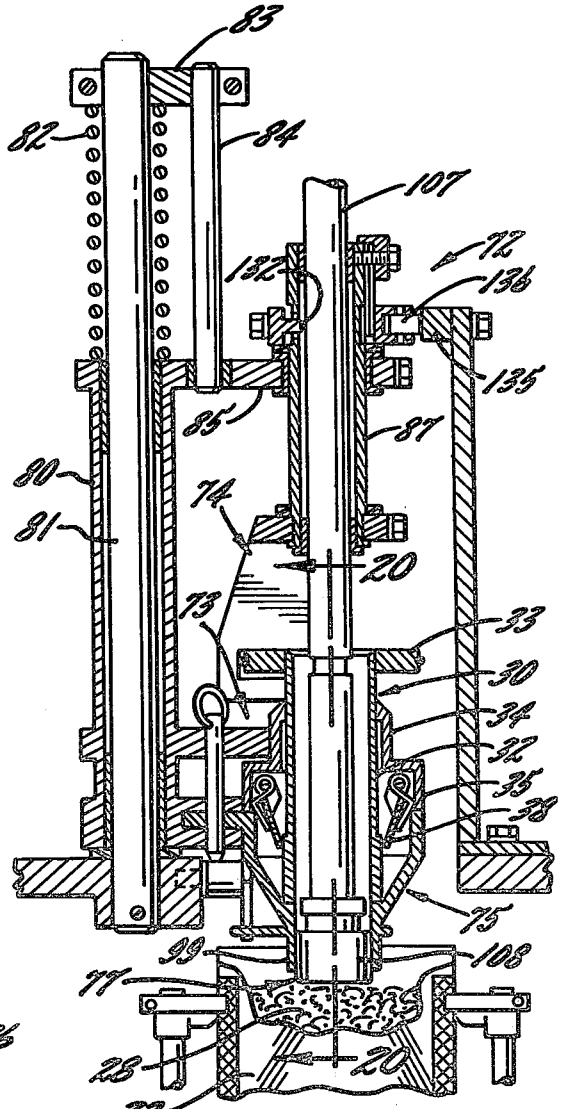
FIGS. 16, 17 and 18 are fragmentary views similar to FIG. 6 and show successively moved positions of various parts of the machine.

The downward movement of the upper sleeve 32 of the container 30 is stopped by virtue of the cam follower 136 (FIG. 17) encountering and engaging the cam track 135. As a result, the latching device 131 is shifted to its unlatched position to move the detent 132 out of the groove 130 in the rod 107 of the plunger 77. The plunger thus is released to move downwardly independently of the sleeve 87. As the plunger so moves, its head 108 slides downwardly through the upper sleeve 32 of the container 30 to forcibly eject the meat chunks 28 from the container and to clean all residual particles from the inside wall of the container (see FIGS. 18 and 20). Downward movement of the plunger 77 continues until the head 108 of the plunger has moved through the spout 99 of the funnel 75 and a short distance below the lower end of the spout (see FIG. 20) so as to insure that no meat chunks remain in the spout and that all of the chunks are forced into the pouch.

The above-described operations all take place during approximately the time the turret 50 is moving the container 30 from a three o'clock position (FIG. 2) to a twelve o'clock position. It will be appreciated that the downward movement which the plunger 77 undertakes during that time is effective to insert the pouch openers 76 into the pouch 22, to lower the spout 99 of the funnel 75 into the pouch, to slide the upper sleeve 32 of the container 30 downwardly and open the container, and finally to forcibly plunge the meat chunks 28 into the pouch.

Shortly after the turret 50 moves the container 30 past the twelve o'clock position, the cam follower 109 (FIGS. 6 and 7) encounters a fall in the cam track 110 to cause the plunger 77 to shift upwardly. Also, the cam follower 136 leaves the track 135 so that the spring 133 may force the latching device 131 to the right toward its latched position and place the detent 132 in sliding engagement with the rod 107 of the plunger.

As the plunger 77 is initially shifted upwardly, it moves independently of and slides upwardly within the sleeve 87 and moves upwardly out of the container 30. When the groove 130 in the rod 107 of the plunger encounters the detent 132, the latter snaps into the groove and latches the sleeve 87 for upward movement with the plunger. Thus, the sleeve 87 moves upwardly and pulls the upper holder 74 upwardly. The fingers 93 of the upper holder engage the flange 33 on the upper sleeve 32 of the container 30 and pull the upper sleeve 32 upwardly within the lower sleeve 34 to allow the doors 38 to close. Also, the upper holder 94 acts against the lower side of the bracket 85 to pull the bracket 85, the sleeve 80 and the funnel 75 upwardly. As the funnel moves upwardly, the fork 103 engages the ears 106 of the pouch openers 76 and swings the openers upwardly out of the pouch. Upward movement of the plunger 77 stops when the various elements have been retracted to the position shown in FIG. 6.

Retraction of the various elements occurs while the turret 50 moves the container 30 from approximately a twelve o'clock position to approximately a nine o'clock position (FIG. 2). Thereafter, the wheels 53 pick the container out of the holders 73 and 74 and deliver the container into the chute 52 for return to the filling apparatus 31.

From the foregoing, it will be apparent that the present invention brings to the art a new and improved machine 21 in which pouches 22 can be filled at high speeds and with relatively large quantities of solid product. The present machine is capable of handling as many as 250 pouches per minute and is capable of filling each pouch with as much as six ounces of solid product. The product is introduced into each pouch in such a manner as to avoid contamination of the top seal area of the pouch and also to insure that all of the product is discharged out of the container and into the pouch. Because pre-weighed quantities of product are brought to the pouch line by the circulating containers 30, the pouch line itself need not be encumbered with apparatus for storing bulk product and for weighing and separating the product into pouch-size quantities.

We claim:

1. A machine for depositing product into upright flexible pouches adapted to be advanced continuously and in equally spaced relation around an arcuate path, said machine comprising a turret having a series of holders located above said path and spaced arcuately from one another in accordance with the spacing of the pouches, mechanism for rotating said turret continuously about an upright axis which coincides with the center of said path, a series of containers adapted to hold said product, means for delivering filled containers to said holders whereby said turret causes said containers to move in overlying registry with said pouches as the latter advance around said path, means carried by said turret for forcing product out of said containers and into said pouches as the pouches advance around said path, and means for removing empty containers from said turret.

2. A machine as defined in claim 1 in which filled containers are advanced in a row to a supply station, means at said supply station for establishing a predetermined spacing between the filled containers advanced to said supply station, said delivering means comprising a wheel rotatable continuously about an upright axis extending parallel to the axis of said turret, said wheel having means for picking up the spaced containers in said supply station and for delivering the containers to the holders of said turret as the turret and wheel rotate.

3. A machine as defined in claim 2 in which said removing means comprise a second wheel rotatable continuously about an upright axis extending parallel to the axes of said turret and said one wheel, said second wheel having means for receiving containers from the holders of said turret as the turret and the second wheel rotate.

4. A machine as defined in claim 3 in which said turret rotates in one direction and in which both of said wheels rotate in the opposite direction.

5. A machine as defined in claim 1 in which each of said containers comprises upper and lower sleeves telescoped slidably together, a gate pivotally mounted on the lower end of said lower sleeve and normally closing the lower end of said upper sleeve to retain product in the container, and means on said turret for sliding the upper sleeve of each container downwardly relative to the lower sleeve thereof after the container has been delivered to said turret, the lower end of said upper sleeve engaging and opening said gate as an incident to downward sliding of said upper sleeve thereby to permit the product to be forced from the container.

6. A machine as defined in claim 5 in which the upper sleeve of each container is telescoped into the lower sleeve thereof, said gate comprising two doors pivotally mounted on said lower sleeve, and means resiliently urging said doors to swing to positions closing the lower end of said upper sleeve.

7. A machine as defined in claim 1 further including a series of angularly spaced funnels carried by said turret and positioned to register with the upper ends of said pouches as the latter are advanced around said path, said funnels underlying said containers when the containers are positioned in said holders, and means for moving each funnel between raised and lowered positions, the lower end of each funnel being disposed above the underlying pouch when the funnel is in its raised position and being disposed within the pouch when the funnel is in its lowered position.

8. A machine as defined in claim 7 further including a pair of pouch openers underlying each of said funnels, each pair of openers being pivotally mounted on said turret and having fingers normally positioned in closely spaced relation above the upper end of the underlying pouch, the openers of each pair having surfaces which are engaged by the lower end portion of the overlying funnel when the latter is moved to its lowered position, the engagement of said funnel with said openers causing the latter to pivot downwardly to place said fingers into the underlying pouch and then to spread the upper end portion of the pouch to an open position preparatory to entry of the funnel into the pouch.

9. A machine as defined in claim 7 in which said containers register with the upper ends of said funnels when said containers are positioned in said holders, and means for moving each container downwardly into its underlying funnel after the container has been positioned in its holder.

10. A machine as defined in claim 9 in which each of said containers comprises upper and lower sleeves telescoped slidably together, a gate pivotally mounted on the lower end of said lower sleeve and normally closing the lower end of said upper sleeve to retain product in the container, and said last-mentioned means sliding the upper sleeve of each container downwardly relative to said lower sleeve and into said funnel, the lower end of said upper sleeve engaging and opening said gate as an incident to downward sliding of said upper sleeve thereby to permit the product to be forced from the container.

11. A machine for depositing product into upright flexible pouches adapted to be advanced continuously and in equally spaced relation around an arcuate path, said machine comprising a turret having a series of holders located above said path and spaced arcuately from one another in accordance with the spacing of the pouches, mechanism for rotating said turret continuously about an upright axis which coincides with the center of said path, a series of angularly spaced funnels carried by said turret and positioned to register with said pouches as the pouches are advanced around said path, each of said funnels being mounted on said turret to move between raised and lowered positions, the lower end of each funnel being disposed above the underlying pouch when the funnel is in its raised position and being disposed within the pouch when the funnel is in its lowered position, a series of angularly spaced plungers carried by said turret and alined vertically with said funnels, each of said plungers being mounted to move vertically between inactive and active positions, the lower end of each plunger being located above the upper end of the underlying funnel when the plunger is in its inactive position and being located adjacent the lower end of the funnel when the plunger is in its active position, a series of containers adapted to hold said product, each of said containers comprising upper and lower sleeves telescoped slidably together, a gate pivotally mounted on the lower end of said lower sleeve and normally closing the lower end of said upper sleeve to retain the product in the container, the lower end of said upper sleeve engaging and opening said gate when said upper sleeve is slid downwardly within said lower sleeve, means for delivering filled containers to said holders, each container being delivered to its respective holder when the associated plunger is in its inactive position and when the associated funnel is in its raised position and being delivered to the holder in a position located between the lower end of the plunger and the upper end of the funnel, means on said turret for moving each funnel to its lowered position, for sliding the upper sleeve of the overlying container downwardly relative to the lower sleeve thereof and into the funnel, and for moving the associated plunger to its active position, said last-mentioned means thereafter raising said plunger to said inactive position, sliding the upper sleeve of the container upwardly relative to the lower sleeve thereof and out of said funnel, and moving said funnel to said raised position, and means for thereafter removing each container from its holder.

12. A machine as defined in claim 11 further including a pair of pouch openers underlying each of said funnels, each pair of openers being pivotally mounted on said turret and having fingers normally positioned in closely spaced relation above the upper end of the underlying pouch, the openers of each pair having surfaces which are engaged by the lower end portion of the overlying funnel when the latter is moved to its lowered position, the engagement of said funnel with said openers causing the latter to pivot downwardly to place said fingers into the underlying pouch and then to spread the upper end portion of the pouch to an open position preparatory to entry of the funnel into the pouch.

* * * * *